US005771580A

United States Patent [19]

Tezuka

[11] Patent Number: 5,771,580

[45] Date of Patent: Jun. 30, 1998

[54] ELECTRIC RAZOR

[75] Inventor: Yoshitaka Tezuka, Tsuna-gun, Japan

[73] Assignee: Sanyo Electric Co., Ltd., Osaka, Japan

[21] Appl. No.: 703,880

[22] Filed: Aug. 27, 1996

[30] Foreign Application Priority Data

Sep. 29, 1995 [JP] Japan ..... 7-253898
Mar. 27, 1996 [JP] Japan ..... 8-072399

[51] Int. Cl.[6] ..... B26B 19/02

[52] U.S. Cl. ..... 30/43.92; 30/45

[58] Field of Search ..... 30/34.1, 43, 43.91, 30/43.92, 44, 45

[56] References Cited

U.S. PATENT DOCUMENTS

| | | | |
|---|---|---|---|
| 3,967,372 | 7/1976 | Beck et al. | 30/43.92 |
| 4,283,848 | 8/1981 | Messinger et al. | 30/34.1 |
| 4,380,869 | 4/1983 | Shirakawa et al. | 30/34.1 |
| 4,845,847 | 7/1989 | Yasunaka et al. | 30/43.92 |
| 4,941,259 | 7/1990 | Wolf | 30/45 |
| 5,022,153 | 6/1991 | Baron | 30/34.1 |
| 5,084,967 | 2/1992 | Nakagawa et al. | 30/34.1 |
| 5,289,636 | 3/1994 | Eichhorn et al. | 30/34.1 |
| 5,423,125 | 6/1995 | Wetzel | 30/34.1 |

FOREIGN PATENT DOCUMENTS 58-55768 4/1983 Japan .

*Primary Examiner*—Maurina T. Rachuba
*Attorney, Agent, or Firm*—Wenderoth, Lind & Ponack

[57] ABSTRACT

An electric razor is provided with a switch clasp on the surface of the main case which can slide up and down to three detents, and a trimmer which opens and closes by operation of the switch clasp. When the switch clasp is moved up to the first detent, power is turned on; when the switch clasp is moved up to the second detent, the trimmer is opened and activated; and when the switch clasp is moved up to the third detent, the trimmer is maintained in the open state but is powered down for cleaning.

20 Claims, 6 Drawing Sheets

ELECTRIC RAZOR

BACKGROUND OF THE INVENTION

This invention relates to an improvement of an electric razor equipped with a trimmer. The electric razor is configured with a battery and driving motor housed within a main case. A power switch clasp is provided on the surface of the main case, and the razor's main blades are provided in a head section. Some electric razors are also provided with trimmer blades along the surface of the main case. These trimmer blades are used for trimming hair such as side burns.

Familiar trimmer blades include those with a fixed position relative to the main case and those that move up and down with exposed blade tips. Open-and-close type trimmer blades which close when not in use to align with the main case and open for use by switch operation to protrude from the side of the main case are also well-known.

A trimmer of the open-and-close type can be stored in a compact fashion since it closes to align with the main case when not in use. The non-protruding stored blade tips of this type of trimmer are protected, and since the stored blade tips are difficult to touch with the fingers this type of trimmer is also superior from a safety and hygienic standpoint.

Concerning switches provided on the main case, an on-off power switch and a switch to open and close a trimmer of the open-and-close type described above may be provided. Further, razors with these switches combined into a single multi-purpose switch clasp have also been demonstrated.

It is desirable to clean the blade tips after every, or every several uses of the trimmer. In the case of the open-and-close type trimmer described above, the trimmer must be cleaned in the open position with a tool such as a brush. Cleaning in the closed position is difficult.

Therefore, in the case of a separate power switch and trimmer switch, the trimmer can be cleaned by opening the trimmer with the power switch off. However, in the case of a razor with a single multi-purpose switch, the switch operates by sliding up and down into two steps or detents. The first detent turns the power on and the second detent opens the trimmer with the power still on. Consequently, since the power is always on when the trimmer is opened, this configuration does not allow trimmer cleaning.

It is thus an object of the present invention to provide an electric razor of the type that combines the power switch and the trimmer opening and closing switch with a configuration that makes it easy to clean the trimmer.

The above and further objects and features of the invention will more fully be apparent from the following detailed description with accompanying drawings.

SUMMARY OF THE INVENTION

The electric razor of the present invention is provided with a switch clasp on the surface of the main case, which operates by sliding up and down into three steps or detents, and a trimmer which is opened or closed depending on the switch position. Movement of the switch clasp up to the first detent switches the power from off to on. Movement up to the second detent moves the trimmer from the closed position to the open position and also switches the trimmer from the un-powered state to an activated state. Finally, movement up to the third detent maintains the trimmer in the open position while switching it from the activated state to an un-powered state.

Further the electric razor of the present invention is convenient to use because the degree of restraint or depth of the third detent is greater than that of the first and second detents making movement up to the third detent harder than to the first and second detents.

In the electric razor of this invention, movement of the switch up to the first detent turns the power on and activates the main blades. Movement of the switch up to the second detent opens the trimmer and activates it for use. At this time, the trimmer may be used alone or in combination with the main blades. For example, the trimmer may be used repeatedly for rough cutting and the main blades for finishing. Finally, movement of the switch up to the third detent puts the trimmer in position for cleaning with a tool such as a brush. At this time, the trimmer is opened but in an un-powered state. Therefore, the back and sides of the blade tips and even the opening and closing pivot axis region are exposed for easy cleaning.

These operations can be performed with one hand by a simple series of movements of a single switch clasp to three detents.

Switch operation is convenient because the degree of restraint or depth of the third detent is greater than that of the first and second detents making movement into the third detent harder than into the first and second detents. Since trimmer cleaning is less frequent than trimmer use, switch movement up to the third detent is infrequent. In an electric razor with a deeper third detent, a different feel is obtained for the operation of moving to the third detent than is obtained in moving to the second detent. Therefore, when the operator wants to activate and use the main blades or the trimmer, excessive switch movement up to the third detent is prevented.

DETAILED DESCRIPTION OF THE INVENTION

Figure 1:
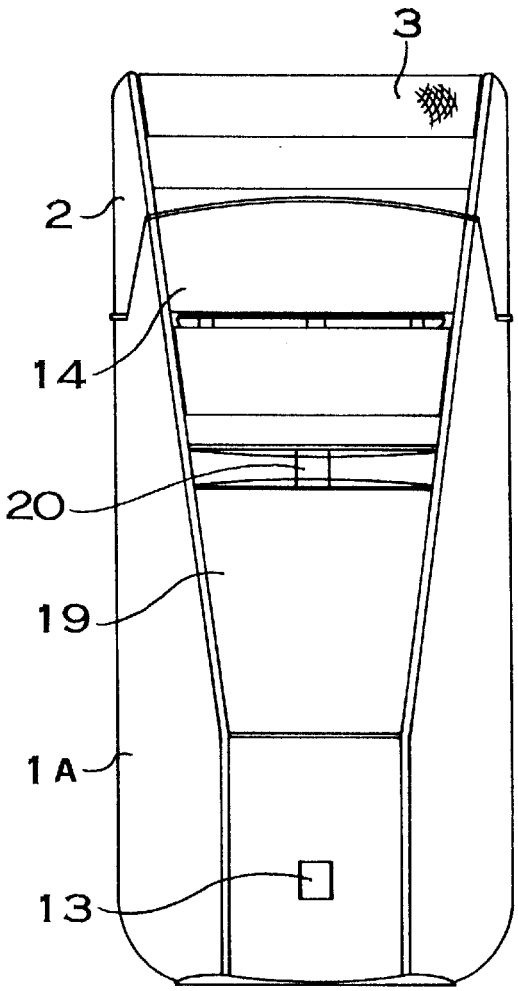
FIG. 1 is a front view of the electric razor of the present invention.
Figure 2:
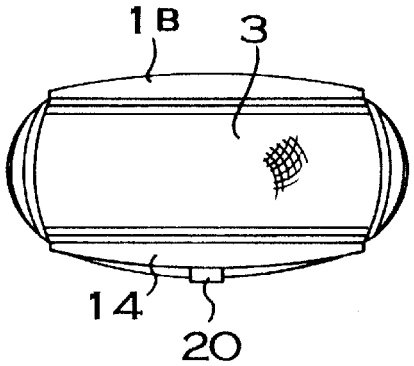
FIG. 2 is a top view of the electric razor of the present invention.
Figure 3:
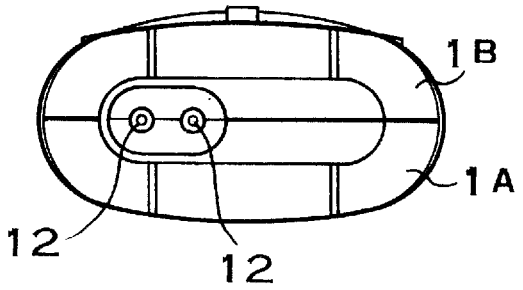
FIG. 3 is a bottom view of the electric razor of the present invention.
Figure 4:
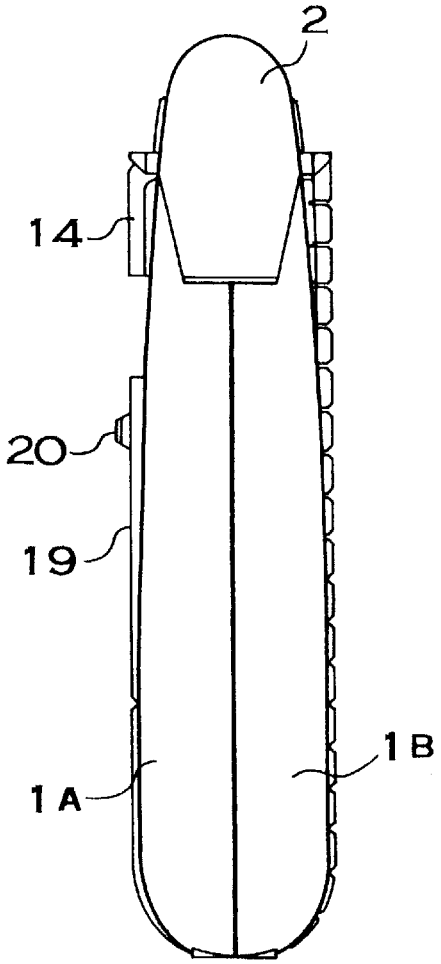
FIG. 4 is a side view of the electric razor of the present invention.

The following is an explanation of the electric razor of an embodiment of the present invention. All the drawings are of an actual electric razor embodiment of the present invention. Referring to the figures, the main case of the electric razor is divided into two sections, a main case 1A and a main case 1B. An outer blade holder 2 is provided at the top of the razor body and disposed in a freely detachable fashion with respect to the main case. Outer blades 3 are mounted in an arch shape on the outer blade holder 2. The inside houses parts such as a printed circuit board 4 with circuit elements mounted on its surface, a nickel cadmium battery 5, a motor 6, and a vibrator 7 that converts rotational motion of the motor 6 to reciprocal motion. An eccentric cam 8 is provided on the rotating shaft of the motor 6. The vibrator 7 moves in reciprocal motion due to eccentric rotation of the eccentric cam 8 within a cavity provided in the vibrator 7. A shaft 9 protrudes from the upper end of the vibrator 7. This shaft 9 connects with inner blades 10. When the outer blade holder 2 is attached to the main case, the inner blades 10 are pushed upward and held in a spring-loaded fashion exactly against the inner surface of the outer blades by a blade pressure spring 11. Throughout this application, upward refers to a direction towards the outer blade holder end of the electric razor.

The nickel cadmium battery 5 is a battery that is reusable with charging (rechargeable battery). A charging circuit is provided on the printed circuit board 4. Charging plug pins 12 are arranged to protrude from the bottom end of the electric razor body, and a charging cord plugs in here to charge the battery with commercial AC power. In addition, a charging light 13 is provided on the front side of the main case to indicate when the battery is being charged.

The electric razor in this embodiment has a trimmer 14. The trimmer 14 comprises stationary blades 15, moveable blades 16, a trimmer activating shaft 17 that connects with the vibrator 7 and provides reciprocal motion to the moveable blades 16, and a spring unit 18 that presses the moveable blades 16 against the stationary blades 15, When the trimmer 14 is not in use, it is stored in a closed fashion to align with the main case. When the trimmer 14 is used, the blade tips pop out in a protruding fashion.

A switch clasp 19 that can slide up and down into three steps or detents is provided on the front side of the main case. The switch clasp 19 is also provided with a locking button 20. Typically, the locking section of the locking button 20 is engaged with the main case to prevent movement of the switch clasp 19. When the locking button 20 is pressed, the lock is released enabling the switch clasp 19 to slide.

First, the low-end position of the switch clasp 19, that can slide up to three detents, is the power-off position. When the switch clasp 19 is moved upward to the first detent, power is turned on initiating reciprocal motion of the inner blades 10 allowing the main blades to be used. At this time, the trimmer 14 is still closed and cannot be used. Next when the switch clasp 19 is moved upward to the second detent, the trimmer projects outward and simultaneously the trimmer activating shaft 17 connects with the vibrator 7 to activate the trimmer 14. Here, activation of the main blades continues. Finally, when the switch clasp 19 is moved upward to the third detent, the power is turned off, but the trimmer 14 is maintained in its open protruding state. Consequently, the trimmer 14 blade tips are easily cleaned in this state.

The switch clasp 19 is connected to a switch support plate 21 through the main case. Namely, the switch clasp 19 is provided with mating studs 22, and these mating studs 22 pass through slits 23 in the main case to engage with mating holes 24 established in the switch support plate 21. As a result, the switch clasp 19 and the switch support plate 21 slide upward as a single unit. Further, the switch support plate 21 is provided with an electrical contact piece 25 which turns electrical power on or off by sliding along the top of the printed circuit board 4.

The switch support plate 21 has a first fork-shaped flexible arm 26 and a second fork-shaped flexible arm 27 with protrusions 28, 29 respectively provided at the tips of the forks. The flexible arms 26, 27 have resiliency which al lows them to open laterally. The first fork-shaped flexible arm 26 projects downward and the second fork-shaped flexible arm 27 projects upward.

In a corresponding fashion, the main case has detent bosses 30, 31 arranged in a vertical line aligned with the gap in the fork of the first fork-shaped flexible arm 26, and detent boss 32 aligned with the gap in the fork of the second fork-shaped flexible arm 27. Consequently, when the switch clasp 19 is moved, the switch can move upwards into two detent positions by the first fork-shaped flexible arm 26 engaging with detent bosses 30, 31. The switch can move upwards into the third detent position by the second fork-shaped flexible arm 27 engaging with the detent boss 32.

Figure 7:
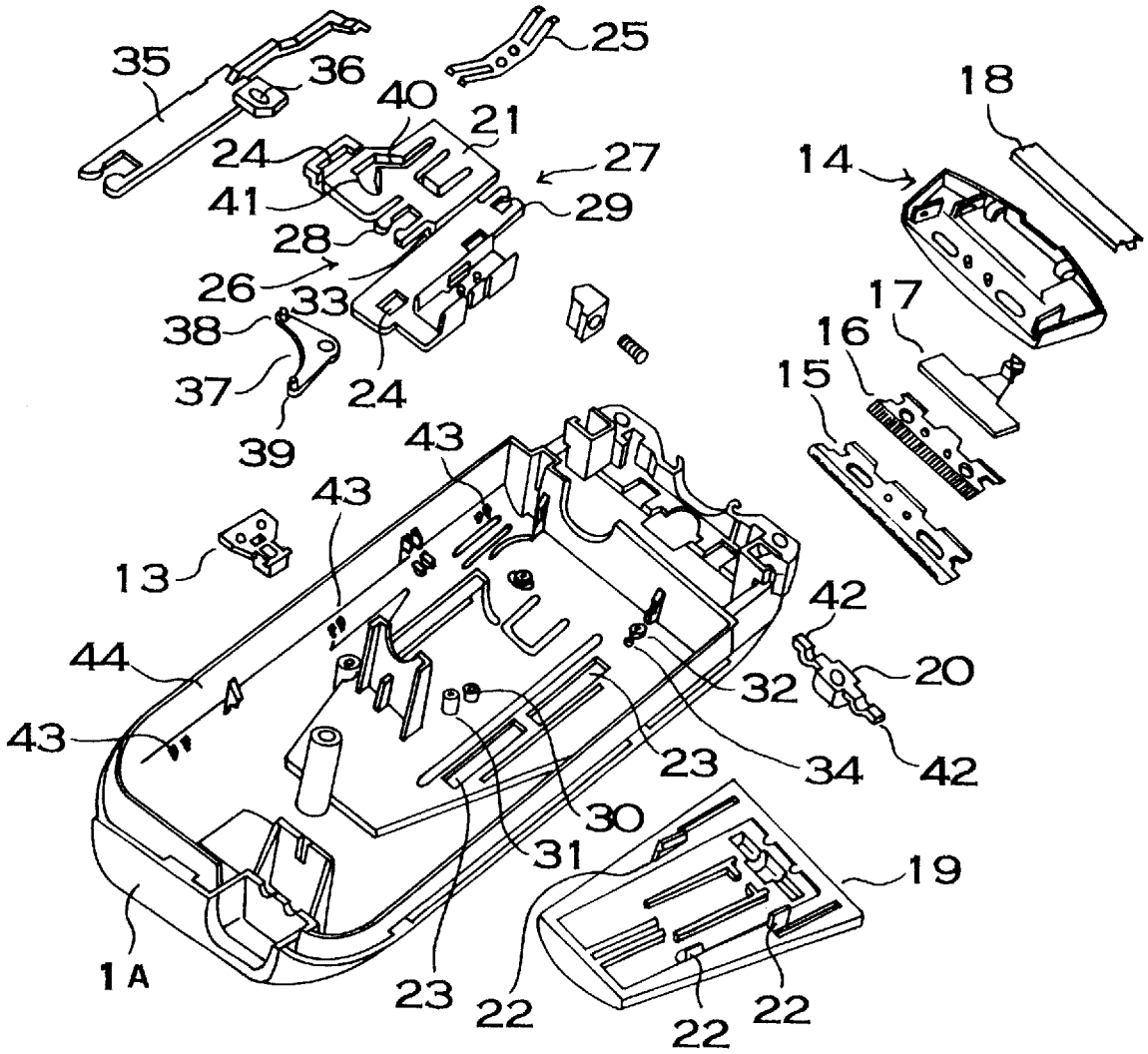
FIG. 7 is an exploded oblique view of important elements of the electric razor of the present invention.
Figure 8:
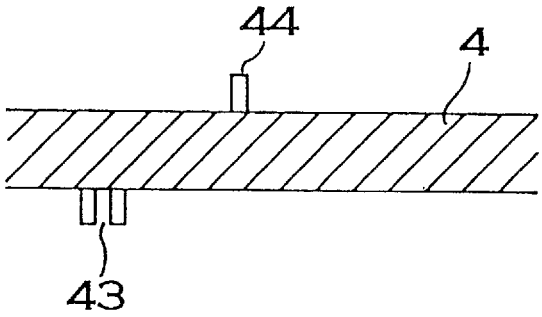
FIG. 8 is a cross-section view showing the printed circuit board mounting of the electric razor of the present invention.

The detent bosses 30, 31 are arranged in a vertical line with detent boss 30 towards the root of the first forked-shaped flexible arm 26; and detent boss 31 towards the tips of the first fork-shaped flexible arm 26. The detent boss 30 towards the root is made lower and the detent boss 31 towards the tips is made higher (see FIGS. 7 and 9). Accordingly, A level change region 33 is provided near the root of the first fork-shaped flexible arm 26 of the switch support plate 21.

Figure 5:
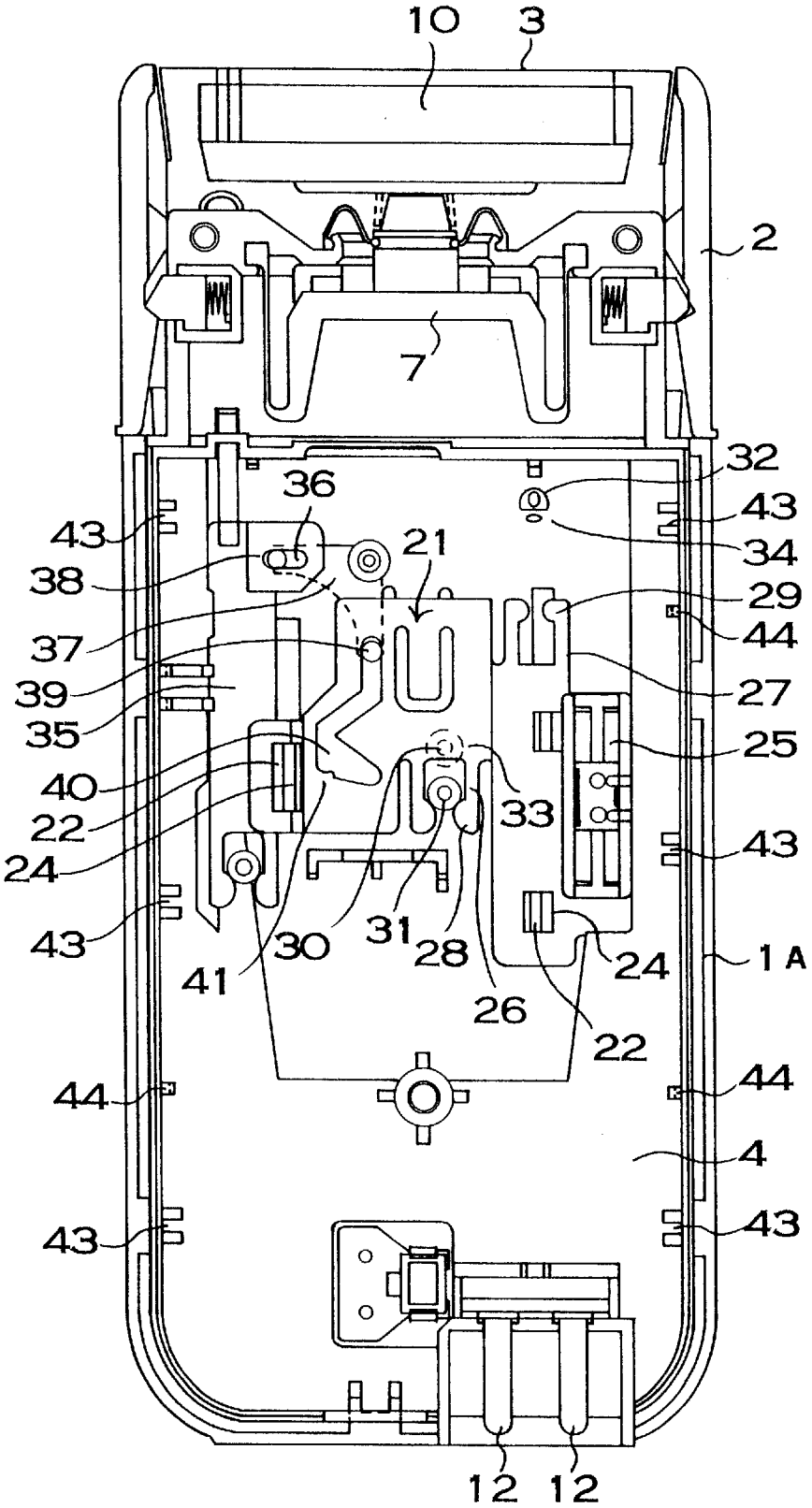
FIG. 5 is an inside view of the electric razor of the present invention.
Figure 6:
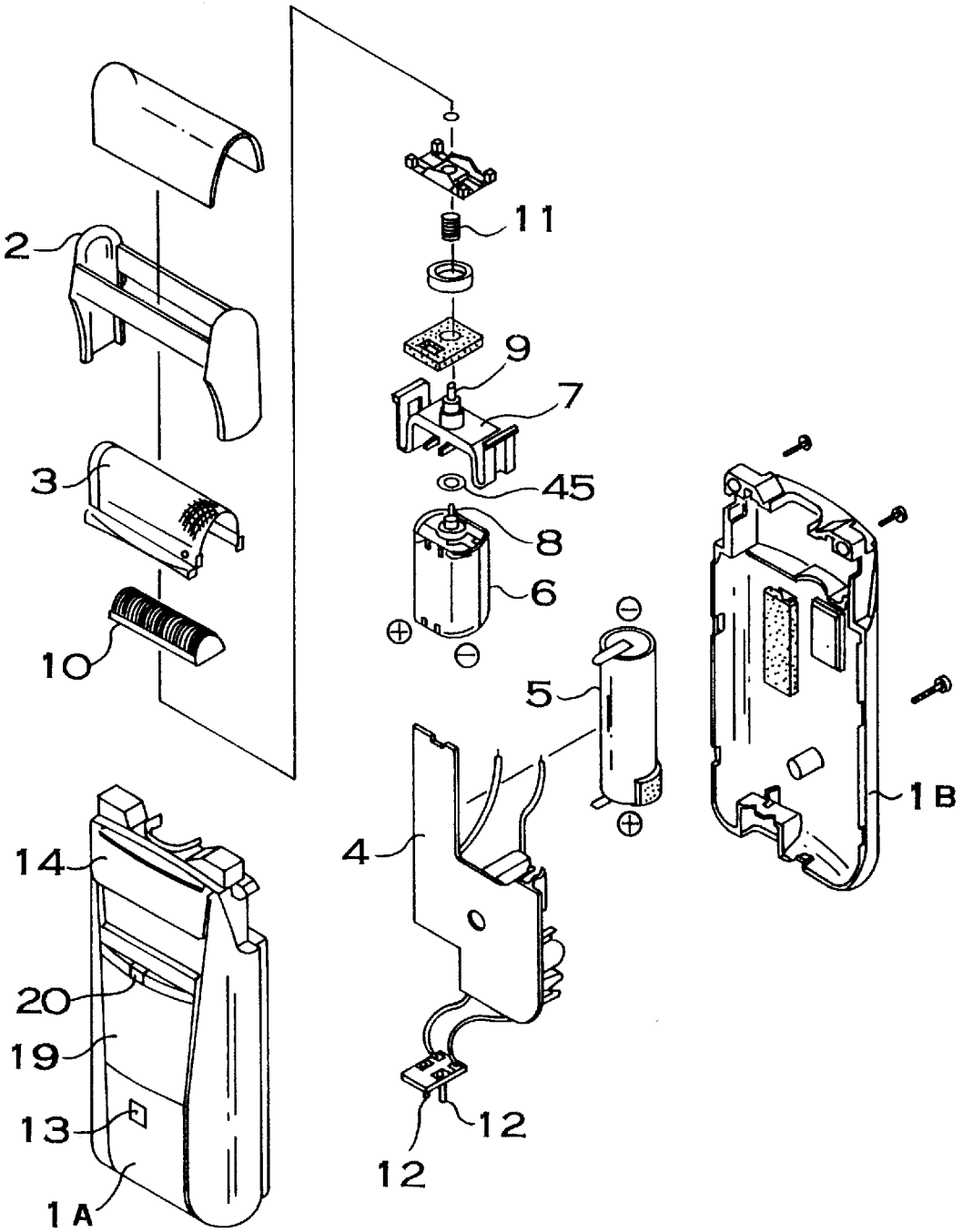
FIG. 6 is an exploded oblique view of the electric razor of the present invention.
Figure 9:
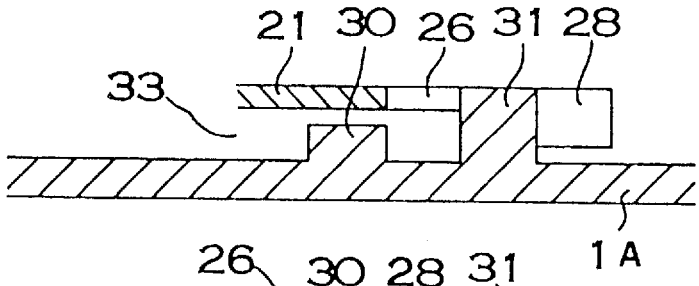
FIG. 9 is a cross-section view showing the relation of the flexible arm and the detent bosses of the electric razor of the present invention.
Figure 9:
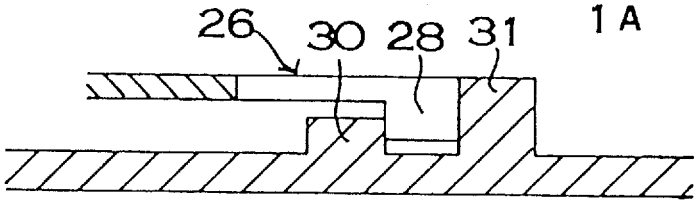
Figure 9:
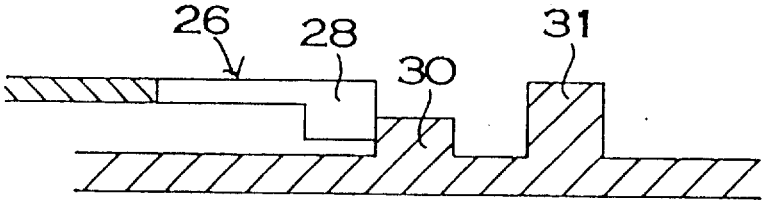

When the switch clasp 19 is in its lower-most position, the protrusions 28 at the tips of the first fork-shaped flexible arm 26 are engaged with the lower side of detent boss 31 as shown in FIGS. 5 and 9(*a*). Here, the length of the first fork-shaped flexible arm 26 is shorter than the sum of the diameters of the detent bosses 30, 31, and the root-end detent boss 30 fits completely within the level change region 33 of the switch support plate 21 (refer to FIGS. 5 and 9(*a*). When the switch clasp 19 is moved upward by one detent, the protrusions 28 move by sliding in a restrained manner around the periphery of detent boss 31 to a position between detent boss 31 and detent boss 30 (refer to FIG. 9*b*). At this time, detent boss 30 moves out from the level change region 33. Next, when the switch clasp 19 is moved upward one more detent, the protrusions 28 again move by sliding in a restrained manner around the periphery of the next detent boss 30 to complete movement into the second detent (refer to FIG. 9*c*). Note the thickness of the protrusions 28 is such that they can engage both of the different height bosses 30, 31.

In this manner, for the electric razor of the present invention with a switch clasp 19 that moves upward to two detents and a single fork-shaped flexible arm 26 which is engageable with the two detent bosses, it is unnecessary to make the length of the fork-shaped flexible arm 26 greater than the sum of the diameters of the detent bosses 30, 31 due to the provision of a level change region 33. Specifically, the first fork-shaped flexible arm 26 can be made short. Consequently, the sense of restrained motion during switch operation does not degrade because the spring-like action of the flexible arm does not weaken.

In the state described above with the switch clasp 19 moved into the second detent, the tip protrusions 29 of the second fork-shaped flexible arm 27 have moved to a position just in front of the detent boss 32. An interim detent boss 34 is provided just under the detent boss 32, and the tip protrusions 29 are just in contact with this interim detent boss 34 at this stage. This interim detent boss 34 has the function of slightly opening the forks of the second fork-shaped flexible arm 27. The purpose of the interim detent boss 34 is to adjust the degree of restraint of the second fork-shaped flexible arm 27. This is to slightly open the fork of the flexible arm 27 allowing the protrusions 29 to slide more easily around detent boss 32 just in case of protrusion 29 angle and gap width variation.

When the switch clasp 19 is moved up to the third detent, the second fork-shaped flexible arm 27 slides around the detent boss 32. The detent boss 32 does not have a true circular shape, but rather its lower side is wider than its upper side. The degree of restraint in the switch motion can also be adjusted by the shape of detent boss 32.

Thus in the electric razor of the present invention, two fork-shaped flexible arms are provided. Movement to the first two detents is due to the first fork-shaped flexible arm 26 and movement to the third and final detent is due to the second fork-shaped flexible arm 27. This is a convenient system when it is desirable to provide a different feel of restraint in switch operation moving up to the third detent compared to that moving to the first two detents. For example, in the present invention, the third detent turns the power off with the trimmer 14 in the open protruding state for trimmer blade cleaning. For this type of seldom used operation, increasing the degree of switch movement restraint is ideal for avoiding accidental movement into the third detent.

The following describes the for trimmer 14 storage and opening structure. The trimmer 14 is connected to the end of a trimmer pop-out lever 35. The pop-out lever 35 has a slit 36 extending laterally, and a projection 38 at the trimmer-end of a rotating lever 37 fits through the slit 36 with play. A projection 39 at the switch-end of the rotating lever 37 fits with play through a slit 40 in the switch support plate 21. The center region of the rotating lever 37 has a rotation axis hole and is supported through that hole by the main case. Further, the trimmer pop-out lever 35 also has a fork-shaped flexible arm which together with mutual action from a boss on the main case creates restraint during sliding.

The slit 40 in the switch support plate 21 comprises four segments; a first straight segment, a first oblique segment, a second straight segment, and a second oblique segment. In addition, the bend between the second straight segment and the second oblique segment is provided with a projection 41.

First, when the switch clasp 19 is in its lower-most position, the switch-end projection 39 of the rotating lever 37 is positioned at the upper end of the first straight segment of the slit 40. When the switch clasp 19 is moved up to the first detent, the switch-end projection 39 moves to the lower end of the first straight segment but the rotating lever 37 still does not rotate. When the switch clasp 19 is slid up one more detent, the switch-end projection 39 moves to the lower end of the first oblique segment. At this time, the rotating lever 37 begins rotating, and the trimmer-end projection 38 pushes the trimmer pop-out lever 35 upward while sliding laterally within the slit 36. When the trimmer pop-out lever 35 is pushed upward, the trimmer 14 is pushed to project outward.

Next, at times such as trimmer 14 cleaning times when the switch is moved to the third detent, the switch-end projection 39 moves to the lower end of the second straight segment. At this time, the trimmer 14 is maintained in the open projecting state.

The following explains the function of the second oblique segment. If after cleaning the open trimmer 14 the user mistakenly tries to hand-close the trimmer, excessive force could be exerted on the rotating lever 37 or the pop-out lever 35. Without the second oblique segment of slit 40, these levers could be damaged. However, with the second oblique segment, even if the trimmer 14 is forced closed, the switch-end projection 39 slides in the second oblique segment to avoid stress on the levers. The projection 41 serves to stop the switch-end projection 39 from slipping down the second oblique segment when the trimmer is not forced.

The above describes switch clasp and trimmer operation while the following discusses detailed parts of the electric razor. The locking button 20 is provided with retaining pieces 42 on both sides of the switch clasp 19. These retaining pieces 42 are mounted on the switch clasp 19 by insertion through a slit section. Therefore, since the switch clasp 19 and locking button 20 can be assembled prior to attachment of the switch clasp 19 to the main case, this configuration results in easy assembly.

Further, there is a shaft bearing housed within the motor 6, and a concave section of a bracket is shaped to accommodate this bearing. Consequently, from its external outline, the motor 6 appears to have a bulge. The electric razor structure is such that this bulge turns out to be exactly where support from the main case is provided. As a result, by putting an O-ring 45 around this bulge, transmission of motor vibration to the case can be attenuated.

Finally, when the printed circuit board 4 is mounted in the main case, it is attached by upward facing hooks 43 and downward facing hooks 44 provided on the main case. These hooks 43, 44 are not paired-off at the same location, but rather are positioned somewhat apart. The printed circuit board 4 is fixed to the main case by sandwiching it between the hooks 43, 44. Some variation in the dimensions of the gap between hooks 43, 44 and the thickness of the printed circuit board 4 is possible. However, with this attachment method, size variation can be absorbed by a certain degree of printed circuit board 4 bending.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims or equivalents of such metes and bounds thereof are therefore intended to be embraced by the claims.

What is claimed is:

1. An electric razor comprising:

a main case;

main blades mounted on said main case;

a trimmer mounted on said main case for movement between a closed position and an open position;

a motor mounted in said main case and drivingly coupled to said main blades and said trimmer;

an electrical contact member movably mounted to said main case for movement between a motor energizing position and a motor off position;

a trimmer pop out member operably connected to said trimmer and movably mounted to said main case for movement between a trimmer opening position and a trimmer closing position;

a switch clasp operably connected to said trimmer pop out member to move said trimmer pop out member between said trimmer opening position and said trimmer closing position, operably connected to said electrical contact member to move said electrical contact member between said motor energizing position and said motor off position, and mounted on said main case for movement between an idle position maintaining said electrical contact member in said motor off position and said trimmer pop out member in said trimmer closing position, a first position maintaining said electrical contact member in said motor energizing position and said trimmer pop out member in said trimmer closing position, a second position maintaining said electrical contact member in said motor energizing position and said trimmer pop out member in said trimmer opening position, and a third position maintaining said electrical contact member in said motor off position and said trimmer pop out member in said trimmer opening position.

2. An electric razor as recited in claim 1, further comprising means for causing resistance to movement of said switch clasp to each of the first, second and third positions, such that resistance to movement of said switch clasp to the third position is greater than resistance to movement of said switch clasp to the first and second positions.

3. An electric razor as recited in claim 1, further comprising a locking button for releasably locking said switch clasp against movement relative to said main case.

4. An electric razor as recited in claim 3, wherein said locking button includes locking sections engaged with said main case, and a button portion for releasing a locking state of said switch clasp upon being pressed.

5. An electric razor as recited in claim 1, further comprising a switch support plate mounted inside said main case and fixed to said switch clasp for movement therewith between said idle position, said first position, said second position and said third position.

6. An electric razor as recited in claim 5, wherein said main case has slits formed therein; and said switch clasp is connected to said switch support plate via mating studs which pass through said slits.

7. An electric razor as recited in claim 5, wherein said electrical contact member is provided on said switch support plate.

8. An electric razor as recited in claim 5, further comprising detent bosses mounted on said main case; and wherein said switch support plate includes flexible legs having base ends, tip ends and protrusions defined at said tip ends, respectively, said protrusions of said flexible legs being engageable with said detent bosses, respectively, for detent restraint to movement of said switch clasp and said switch support plate relative to said main case.

9. An electric razor as recited in claim 8, wherein said switch clasp and said switch support plate are movable relative to said main case in a first direction and a second direction opposite said first direction;

a plurality of said detent bosses are spaced apart from one another along a line in said first direction; and an uppermost boss of said plurality of said detent bosses is shorter than a lowermost boss of said plurality of said detent bosses.

10. An electric razor as recited in claim 9, wherein said flexible legs include a first flexible leg and a second flexible leg;

said detent bosses include a pair of detent bosses with which said first flexible leg is engageable to restrain movement of said switch support plate and said switch clasp in said first direction, and another detent boss with which said second flexible leg is engageable to restrain movement of said switch support plate and said switch clasp in said first direction.

11. An electric razor as recited in claim 8, wherein said switch clasp and said switch support plate are movable relative to said main case in a first direction and a second direction opposite said first direction;

a plurality of said detent bosses are spaced apart from one another along a line in said first direction;

said tip end of one of said flexible legs includes a projecting region projecting toward a portion of said main case on which said detent bosses are mounted for engagement with said detent bosses, respectively, such that said tip end can engage with one of said detent bosses while a remaining portion of said one of said flexible legs is disposed adjacent another of said detent bosses; and a length of said one of said flexible legs is shorter than a sum of diameters of said plurality of detent bosses.

12. An electric razor as recited in claim 8, wherein said detent bosses include first and second detent bosses; and said flexible legs include a first flexible leg engageable with said first detent boss and a second flexible leg engageable with said second detent boss.

13. An electric razor as recited in claim 12, wherein said switch clasp and said switch support plate are movable relative to said main case in a first direction and a second direction opposite said first direction; and said first flexible leg extends in said first direction, and said second flexible leg extends in said second direction.

14. An electric razor as recited in claim 13, wherein said detent bosses include a pair of detent bosses with which said first flexible leg is engageable to restrain movement of said switch support plate and said switch clasp in said first direction, and another detent boss with which said second flexible leg is engageable to restrain movement of said switch support plate and said switch clasp in said first direction.

15. An electric razor as recited in claim 8, wherein said flexible legs respectively comprise fork-shaped flexible legs; and said detent bosses include a primary detent boss and an intermediate detent boss, one of said fork-shaped flexible legs being engageable with both said primary detent boss and said intermediate detent boss such that, when said switch support plate is moved in a first direction, said one of said fork-shaped flexible legs is initially opened a first amount by said intermediate detent boss and then a second amount, greater than said first amount, by said primary detent boss.

16. An electric razor as recited in claim 1, further comprising a switch support plate mounted inside said main case and fixed to said switch clasp for movement therewith between said idle position, said first position, said second position and said third position; and a rotating lever pivotally mounted to said main case and engaged with said switch support plate;

wherein said trimmer pop out member comprises a trimmer pop out lever engaged with said rotating lever such that said trimmer pop out lever is connected to said switch support plate via said rotating lever.

17. An electric razor as recited in claim 16, wherein said switch support plate is movable in a first direction and a second direction opposite said first direction;

said trimmer pop out lever has a slit formed therein extending laterally with respect to said first and second directions;

said switch support plate has a slit formed therein;

said rotating lever has a trimmer-end projection and a switch-end projection, said trimmer-end projection being engaged in said slit of said trimmer pop out lever and said switch-end projection being engaged in said slit of said switch support plate.

18. An electric razor as recited in claim 17, wherein said slit of said switch support plate includes: a first straight segment having a first end and a second end; a first oblique segment having a first end contiguous with said second end of said first straight segment, and a second end; a second straight segment having a first end contiguous with said first oblique segment, and a second end; and a second oblique segment having a first end contiguous with said second straight segment, and a second end; an engagement projection extending into said slit of said switch support plate at a junction between said second straight segment and said second oblique segment.

19. An electric razor as recited in claim 18, wherein said switch clasp, said switch support plate, said electrical contact member, said trimmer pop out lever and said rotating lever are arranged such that: when said switch clasp is in said idle position, said switch-end projection of said rotating lever is positioned at said first end of said first straight segment; when said switch clasp is moved to said first position from said idle position, said switch-end projection moves to said second end of said first straight segment without rotating said rotating lever; when said switch clasp is moved to said second position from said first position, said switch-end projection is moved to said second end of said first oblique segment, and said rotating lever rotates causing said trimmer-end projection to slide in said slit of said trimmer pop out lever, thereby moving said trimmer to its open position; and when said switch clasp is moved to said third position from said second position, said switch-end projection moves to said second end of said second straight segment, said trimmer is maintained in its open position and said electrical contact member is moved to its motor off position.

20. An electric razor as recited in claim 19, wherein said engagement projection comprises a means for normally retaining said switch-end projection at said second end of said second straight segment when said switch clasp is in said third position, but for allowing said switch-end projection to move from said second end of said second straight segment to said second end of said second oblique segment when when external presses said trimmer from its open position to its closed position.

* * * * *